US005169828A

United States Patent [19]

Janssens et al.

[11] Patent Number: 5,169,828

[45] Date of Patent: Dec. 8, 1992

[54] BLACK COLORED THERMAL DYE SUBLIMATION TRANSFER DONOR ELEMENT

[75] Inventors: Wilhelmus Janssens, Aarschot; Luc J. Vanmaele, Lochristi, both of Belgium

[73] Assignee: Agfa-Gevaert, N.V., Mortsel, Belgium

[21] Appl. No.: 682,389

[22] Filed: Apr. 9, 1991

[30] Foreign Application Priority Data

Apr. 20, 1990 [EP] European Pat. Off. ..... 90200991.9

[51] Int. Cl.[5] ..... B41M 5/035; B41M 5/38

[52] U.S. Cl. ..... 503/227; 428/195; 428/480; 428/913; 428/914

[58] Field of Search ..... 8/471; 428/195, 480, 428/913, 914; 503/227

[56] References Cited

FOREIGN PATENT DOCUMENTS 1012392 1/1986 Japan ..... 503/227

*Primary Examiner*—B. Hamilton Hess

*Attorney, Agent, or Firm*—Breiner & Breiner

[57] ABSTRACT

Black colored dye-donor element for use according to thermal dye sublimation transfer comprising a support having thereon a dye layer containing a mixture of a magenta 4-chloro-5-formylthiazol-2-ylazoaniline dye and at least one cyan dye and at least one yellow dye.

20 Claims, No Drawings

BLACK COLORED THERMAL DYE SUBLIMATION TRANSFER DONOR ELEMENT

DESCRIPTION

The present invention relates to black colored dye-donor elements for use according to thermal dye sublimation transfer.

Thermal dye sublimation transfer also called thermal dye diffusion transfer is a recording method in which a dye-donor element provided with a dye layer containing sublimable dyes having heat transferability is brought into contact with a receiver sheet and selectively, in accordance with a pattern information signal, heated with a thermal printing head provided with a plurality of juxtaposed heat-generating resistors whereby dye from the selectively heated regions of the dye-donor element is transferred to the receiver sheet and forms a pattern thereon, the shape and density of which is in accordance with the pattern and intensity of heat applied to the dye-donor element.

A dye-donor element for use according to thermal dye sublimation transfer usually comprises a very thin support e.g. a polyester support, one side of which is covered with a dye layer, which contains the printing dyes. Usually an adhesive or subbing layer is provided between the support and the dye layer. Normally the opposite side is covered with a slipping layer that provides a lubricated surface against which the thermal printing head can pass without suffering abrasion. An adhesive layer may be provided between the support and the slipping layer.

The dye layer can be a monochrome dye layer or it may comprise sequential repeating areas of different colored dyes like e.g. of cyan, magenta, yellow and optionally black hue. When a dye-donor element containing three or more primary color dyes is used, a multicolor image can be obtained by sequentially performing the dye transfer process steps for each color.

For obtaining black recording by thermal dye sublimation transfer, transfer is performed using a dye-donor element having a black colored layer usually containing a mixture of yellow, magenta and cyan colored image dyes. Mixtures of yellow, magenta and cyan dyes for the formation of a black colored layer are described in e.g. U.S. Pat. No. 4,816,435 and JP 01/136787.

By using a mixture of yellow, magenta and cyan image dyes a visual black color is generally not obtained or is only obtained by using said dyes in a relatively high concentration.

Furthermore these known black colored transfer sheets are insufficient in performance in that the density of the transferred black image is too low, especially when transfer is effected onto a transparant material.

Therefore it is an object of the present invention to provide novel black colored dye-donor elements for use according to thermal dye sublimation transfer that give visual black images with a lower concentration of dyes.

It is another object of the present invention to provide novel black colored dye-donor elements for use according to thermal dye sublimation transfer that give high density black images.

It is another object of the present invention to provide a magenta dye for use in a black colored dye-donor element having ideal spectral characteristics (broad absorption spectra), high tinctorial strength and high optical densities on printing.

Other objects will become apparent from the description hereinafter.

In accordance with the present invention a black colored dye-donor element for use according to thermal dye sublimation transfer is provided, said black colored dye-donor element comprising a support having thereon a dye layer containing a dye capable of being transferred to a receiving element, the densities of a transferred pixel of said dye satisfying the following equations:

$$\frac{D_1 + D_2}{D_{max}} \geqq 1.5 \text{ and } D_1 \geqq \frac{D_{max}}{2} \text{ and } D_2 \geqq \frac{D_{max}}{2}$$

wherein $D_{max}$ is the density at the wavelength of maximum density, $D_1$ is the density at 595 nm (i.e. the wavelength of maximum eye sensitivity for green) and $D_2$ is the density at 555 nm (i.e. the wavelength of maximum eye sensitivity for red).

Preferably $(D_1+D_2)/D_{max}$ is at least 1.6 and more preferably at least 1.8.

By using in the black dye donor element a dye that satisfies the above equations it may be possible depending upon the shape of the shoulders of the absorption curve of said dye to obtain a visual black image by using a mixture of only two dyes, namely said dye and a yellow dye. Alternatively it may be necessary to add a third dye (magenta or cyan) but in a much lower concentration than in the known mixtures for black dye-donor elements.

The black colored dye layer of the dye-donor element of this invention is obtained by compounding the dye satisfying the above equations, a yellow dye and possibly also a cyan or magenta dye at a ratio such that a substantially uniform density over the whole visible spectrum range is obtained for the recorded image.

The diffusion coefficients of each of the dyes that are used in a mixture for formation of a black image are preferably between 0.7 and 1.3 and more preferably between 0.9 and 1.1 times the diffusion coefficient of each of the other dyes of said mixture; the diffusion coefficients being measured as described in EP 386250.

Examples of dyes that satisfy the above equations include:

Dye 1

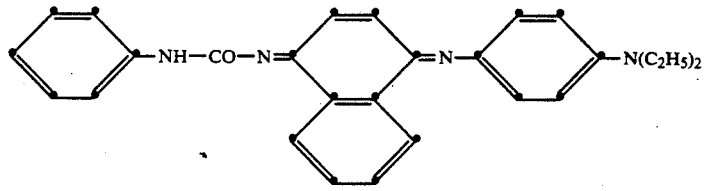

as described in EP 394563;

-continued
Dye 2
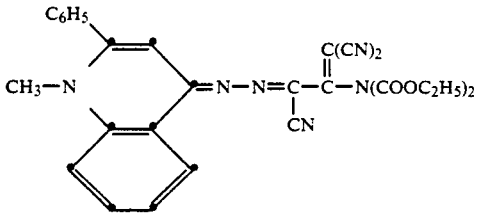
as described in EP 400706;
Dye 3
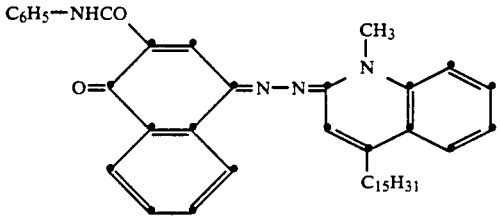
as described in GB 1392433;
Dye 4
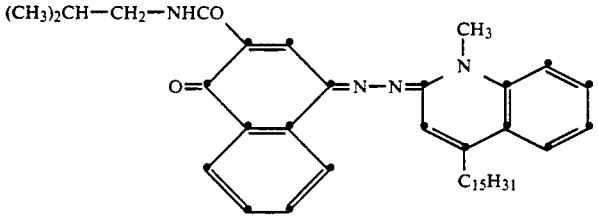
as described in GB 1392433;
Dye 5
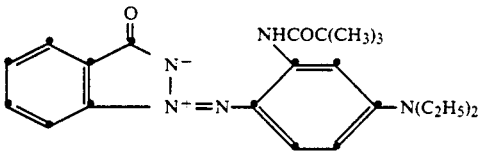
as described in EP 279467;
Dye 6
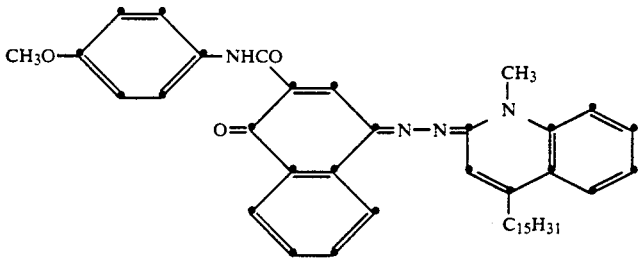
as described in GB 1392433;
Dye 7
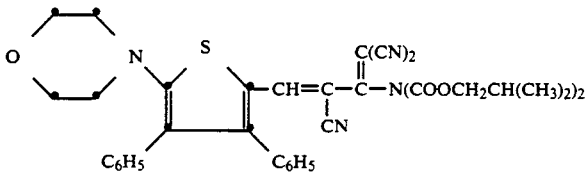
as described in EP 400706;
Dye 8
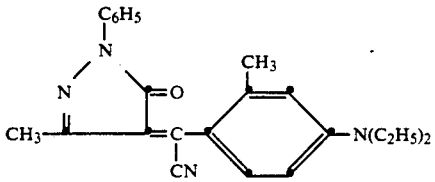
as described in US 4839336;

-continued
Dye 9
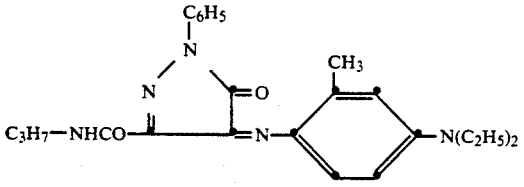
as described in JP 59/184339;
Dye 10
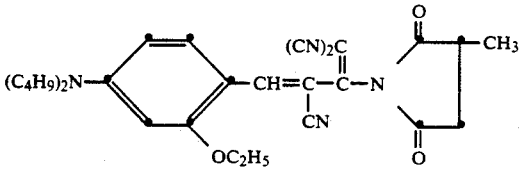
as described in EP 400706;
Dye 11
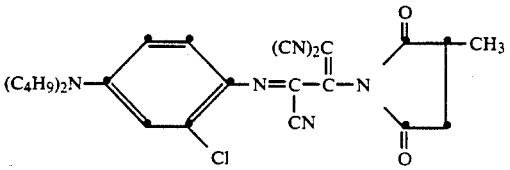
as described in EP 400706;
Dye 12
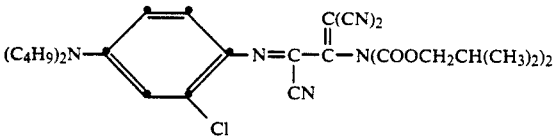
as described in EP 400706;
Dye 13
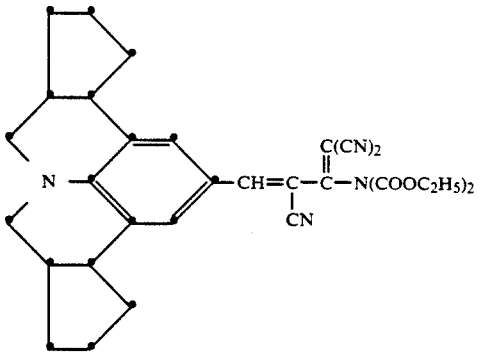
as described in EP 400706;
Dye 14
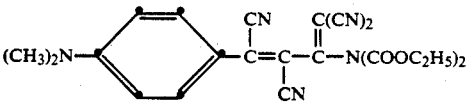
as described in EP 400706;
Dye 15
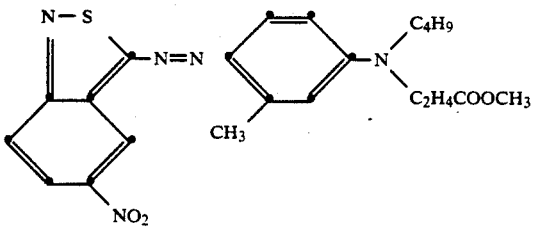
as described in EP 216483;

-continued

Dye 16

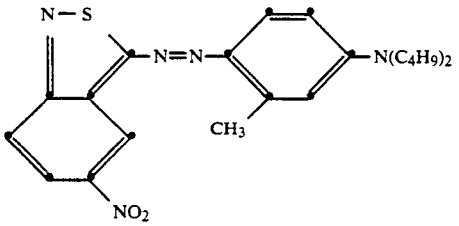

as described in EP 216483;

Dye 17

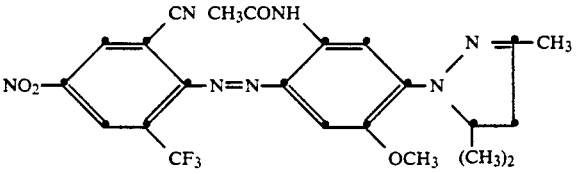

as described in EP 216483;

Dye 18

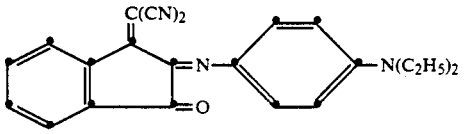

as described in EP 384040;

Dye 19

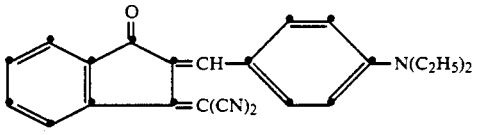

as described in EP 384040;

Dye 20

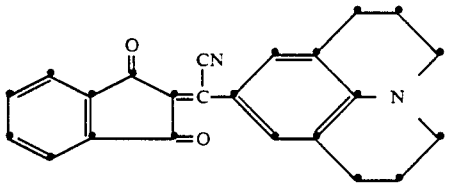

as described in EP 384040;

Dye 21

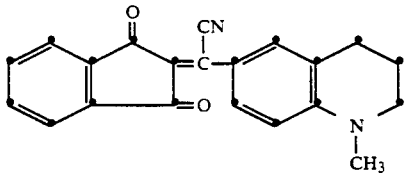

as described in EP 384040;

Dye 22

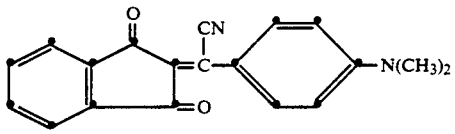

as described in EP 384040;

Dye 23

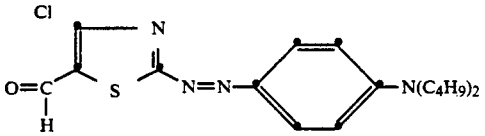

Of the dyes that satisfy the above equations especially magenta 4-chloro,5-formylthiazol-2-ylazoaniline dyes are preferred.

4-Chloro,5-formylthiazol-2-ylazoaniline dyes for use according to the present invention can be represented by the following formula

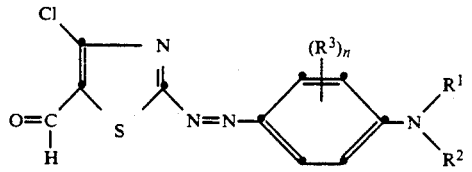

wherein:

$R^1$ and $R^2$ each independently represent hydrogen, a substituted or unsubstituted alkyl group, a substituted or unsubstituted cycloalkyl group, a substituted or unsubstituted aryl group, a substituted or unsubstituted allyl group, a substituted or unsubstituted alkenyl group, or $R^1$ and $R^2$ together with the nitrogen to which they are attached form the necessary atoms to close a 5- or 6-membered heterocyclic ring, or $R^1$ and/or $R^2$ together with the nitrogen to which they are attached and either or both carbon atoms of the phenyl ring ortho to said nitrogen atom form a 5- or 6-membered heterocyclic ring;

$R^3$ represents a halogen atom, a hydroxy group, a cyano group, a substituted or unsubstituted alkyl group, a substituted or unsubstituted cycloalkyl group, a substituted or unsubstituted aryl group, a substituted or unsubstituted alkoxy group, a substituted or unsubstituted aryloxy group, a substituted or unsubstituted alkylthio group, a substituted or unsubstituted arylthio group, a substituted or unsubstituted amino group, a substituted or unsubstituted alkylcarbonylamino group, a substituted or unsubstituted arylcarbonylamino group, a substituted or unsubstituted alkylsulfonylamino group, a substituted or unsubstituted arylsulfonylamino group, a substituted or unsubstituted alkoxycarbonylamino group, a substituted or unsubstituted aryloxycarbonylamino group, a substituted or unsubstituted alkylthiocarbonylamino group, a substituted or unsubstituted arylthiocarbonylamino group, a substituted or unsubstituted alkylphosphoramidate group, a substituted or unsubstituted arylphosphoramidate group, a substituted or unsubstituted alkylphosphonamidate group, a substituted or unsubstituted arylphosphonamidate group;

n represents 0, 1, 2, 3 or 4; the $R^3$ substituents may be the same or different when n is greater than 1.

Preferably $R^1$ and $R^2$ (same or different) represent a $C_1$–$C_6$ alkyl group and n represents 0 or 1; in case n is 1 $R_3$ is preferably alkyl or alkoxy or amino or alkylcarbonylamino preferably in ortho position to the azo link.

Magenta 4-chloro,5-formylthiazol-2-ylazoaniline dyes have been described for use in the magenta colored thermal dye sublimation transfer donor element (e.g. in EP 216483 and in EP 258856). However they have not been described for use in a black colored donor element.

Examples of magenta 4-chloro,5-formylthiazol-2-ylazoaniline dyes for use according to the present invention are listed in table 1 below.

TABLE 1

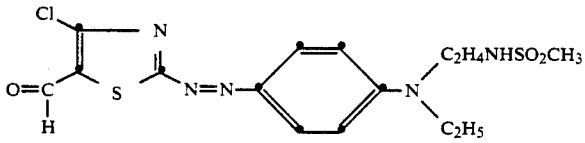

M1

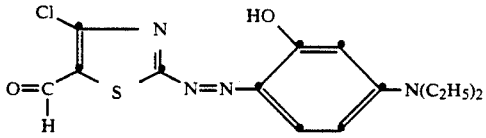

M2

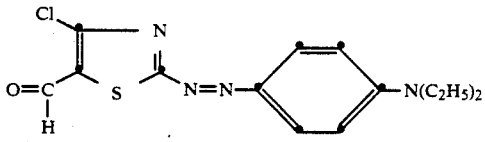

M3

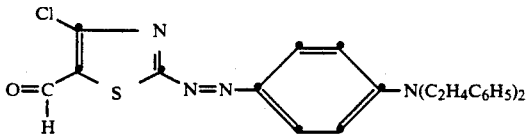

M4

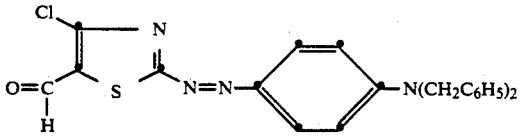

M5

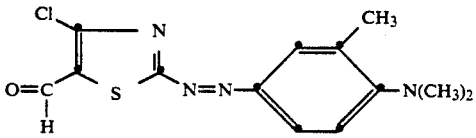

M6

TABLE 1-continued
M7
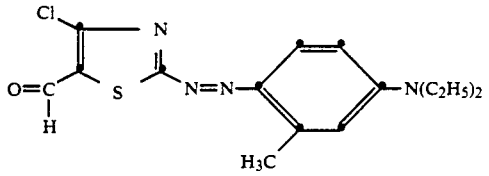
M8
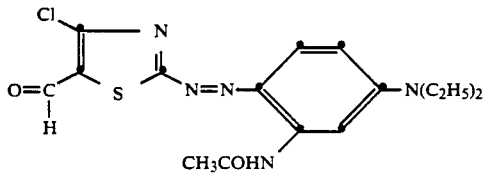
M9
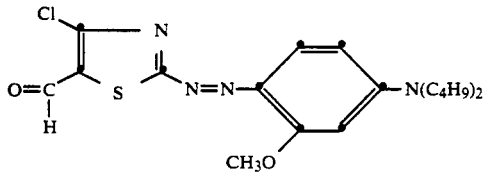
M10
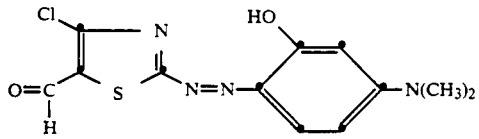
M11
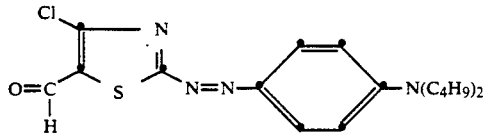
M12
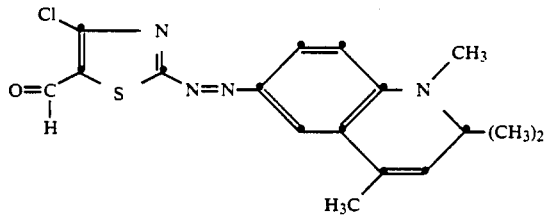
M13
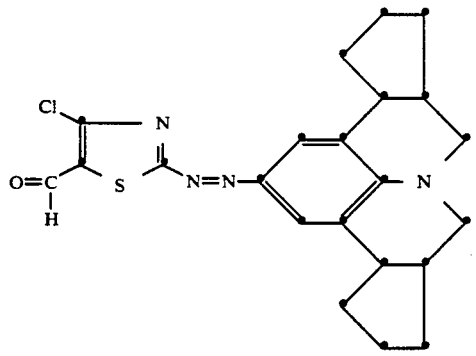
M14
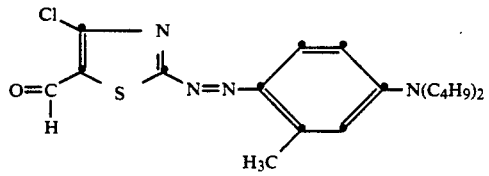

TABLE 1-continued
M15
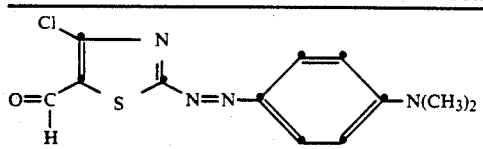
M16
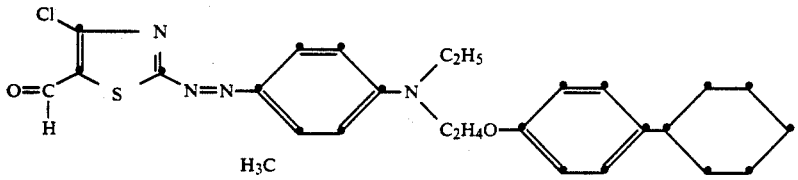
M17
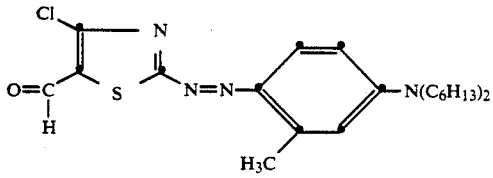
M18
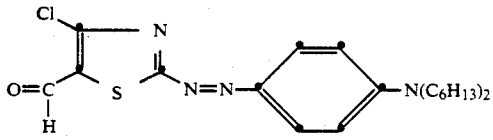
M19
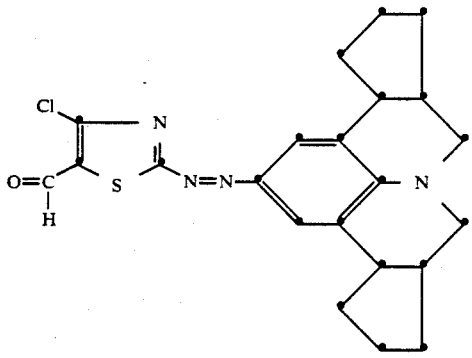
M20
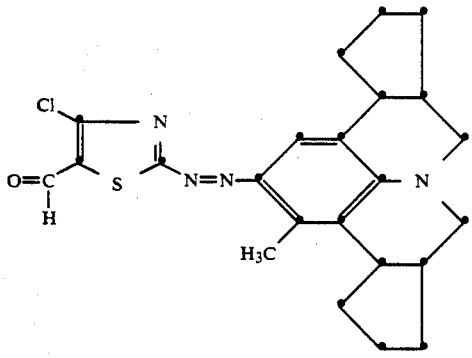
The magenta dyes of the present invention have absorption maxima mostly in the range of from 520 to 600 nm.
In table 2 are listed absorption maxima ($\lambda_{max}$) and extinction coefficients ($\epsilon$) of some of the dyes listed above in table 1 in methanol.
TABLE 2
| | dye | $\lambda_{max}$ (nm) | $\epsilon$(1 mol$^{-1}$ cm$^{-1}$) |
|---|---|---|---|
| | M3 | 558 | 45420 |
| | M4 | 550 | 45657 |
| | M5 | 526 | 24694 |
| | M6 | 501 | 23083 |
| | M7 | 577 | 51769 |
| | M9 | 577 | 56959 |
| (a) | M10 | 542 | 45555 |
| | M12 | 591 | 44486 |

TABLE 2-continued

| dye | $\lambda_{max}$ (nm) | $\epsilon$(1 mol$^{-1}$ cm$^{-1}$) |
|---|---|---|
| M14 | 581 | 53094 |
| M15 | 547 | 42514 |
| M16 | 569 | 37958 |
| M19 | 582 | 23522 |
| M20 | 613 | 46399 |

(a) mixture methanol/dichloromethane 1:1 instead of methanol

Magenta 4-chloro,5-formylthiazol-2-ylazoaniline dyes according to the present invention are prepared along the lines described in U.S. Pat. Nos. 4,395,544 and 4,505,857.

The compounding ratio of the magenta 4-chloro,5-formylthiazol-2-ylazoaniline dye, cyan and yellow dyes in the black mixture is properly from 20 to 80% by weight for the magenta dye, from 10 to 40% by weight for the cyan dye and from 10 to 40% by weight for the yellow dye, and more preferably from 30 to 60% by weight for the magenta dye, from 20 to 40% by weight for the cyan dye and from 10 to 30% by weight for the yellow dye.

Suitable cyan dyes for use together with the magenta 4-chloro,5-formylthiazol-2-ylazoaniline dye in the formation of the black colored layer include the cyan dyes described in EP 400706, the cyan dyes described in U.S. Pat. No. 4,816,435 and the cyan dyes obtained by chain elongation of the formyl substituent of the magenta 4-chloro,5-formylthiazol-2-ylazoaniline dye used in the present invention with an active methylene function such as described in EP 352006.

The latter cyan dyes are particularly preferred. They can be represented by the following formula

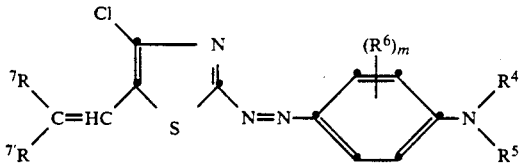

wherein:

$R^4$, $R^5$, $R^6$ and m can each have any of the significances given to respectively $R^1$, $R^2$, $R^3$ and n above;

$R^7$ and $R^{7'}$ each independently represent a cyano group, a substituted or unsubstituted alkoxycarbonyl group, a substituted or unsubstituted alkenyloxycarbonyl group, a substituted or unsubstituted aryloxycarbonyl group, a substituted or unsubstituted alkylaminocarbonyl group, a substituted or unsubstituted arylaminocarbonyl group, a substituted or unsubstituted alkylcarbonyl group, a substituted or unsubstituted arylcarbonyl group, a substituted or unsubstituted alkylsulfonyl group, a substituted or unsubstituted arylsulfonyl group, or $R^7$ and $R^{7'}$ together with the carbon to which they are attached form the necessary atoms to close a 5- or 6-membered ring including a 5- or 6-membered heterocyclic ring.

Preferably $R^7$ and $R^{7'}$ each represent a cyano group and $R^4$ and $R^5$ (same or different) represent a $C_1$–$C_6$ alkyl group and m represents 0 or 1 with $R^6$ being alkyl or amino or alkoxy or alkylcarbonylamino.

Other preferred cyan dyes are those described in EP 400706 and which can be represented by the following formula

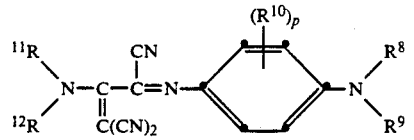

wherein:

$R^8$, $R^9$, $R^{10}$ and p each can have any of the significances given to respectively $R^1$, $R^2$, $R^3$ and n above;

$R^{11}$ and $R^{12}$ each independently represent hydrogen, alkyl, cycloalkyl, aryl, alkylsulfonyl, arylsulfonyl, alkylsulfonylamino, arylsulfonylamino, alkylcarbonyl, alkoxycarbonyl, alkylthio, or $R^{11}$ and $R^{12}$ together with the nitrogen to which they are attached represent the necessary atoms to close a heterocyclic nucleus or substituted heterocyclic nucleus, including a heterocyclic nucleus with an aliphatic or aromatic ring fused-on.

Preferably $R^{11}$ and $R^{12}$ each represent alkoxycarbonyl or alkylsulfonylamino or $R^{11}$ and $R^{12}$ together with the nitrogen to which they are attached represent succinimido and $R^8$ and $R^9$ (same or different) represent a $C_1$–$C_6$ alkyl group and p represents 0 or 1 with $R^{10}$ being alkyl or alkylcarbonylamino.

Other preferred cyan dyes are azomethine dyes which can be represented by the following formula

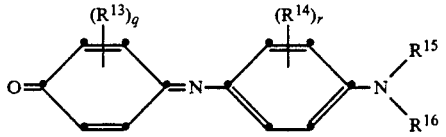

wherein:

$R^{14}$ represents a halogen atom, a hydroxy group, a cyano group, a substituted or unsubstituted alkyl group, a substituted or unsubstituted cycloalkyl group, a substituted or unsubstituted aryl group, a substituted or unsubstituted alkoxy group, a substituted or unsubstituted aryloxy group, a substituted or unsubstituted alkylthio group, a substituted or unsubstituted arylthio group, a substituted or unsubstituted amino group, a substituted or unsubstituted alkylcarbonylamino group, a substituted or unsubstituted arylcarbonylamino group, a substituted or unsubstituted alkylsulfonylamino group, a substituted or unsubstituted arylsulfonylamino group, a substituted or unsubstituted alkoxycarbonylamino group, a substituted or unsubstituted aryloxycarbonylamino group, a substituted or unsubstituted alkylthiocarbonylamino group, a substituted or unsubstituted arylthiocarbonylamino group, a substituted or unsubstituted alkylphosphoramidate group, a substituted or unsubstituted arylphosphoramidate group, a substituted or unsubstituted alkylphosphonamidate group, a substituted or unsubstituted arylphosphonamidate group, a substituted or unsubstituted alkylaminocarbonyl group, a substituted or unsubstituted arylaminocarbonyl group; or $R^{14}$ represents the necessary atoms to close a alicyclic or aromatic or heterocyclic ring fused-on the phenyl ring;

r represents 0, 1, 2, 3 or 4; the $R^{14}$ substituents may be the same or different when r is greater than 1;

$R^{13}$ can have any of the significances given to $R^{14}$ or can represent the necessary atoms to close a alicyclic or aromatic or heterocyclic ring fused-on the phenylene ring;

q represents 0, 1, 2, 3 or 4; the $R^{13}$ substituents may be the same or different when q is greater than 1;

$R^{15}$ and $R^{16}$ each independently represent hydrogen, a substituted or unsubstituted alkyl group, a substituted or unsubstituted cycloalkyl group, a substituted or unsubstituted aryl group, a substituted or unsubstituted allyl group, a substituted or unsubstituted alkenyl group, or $R^{15}$ and $R^{16}$ together with the nitrogen to which they are attached form the necessary atoms to close a 5- or 6-membered heterocyclic ring, or $R^{15}$ and/or $R^{16}$ together with the nitrogen to which they are attached and either or both carbon atoms of the phenyl ring ortho to said nitrogen atom form a 5- or 6-membered heterocyclic ring.

Examples of suitable cyan dyes are listed in table 3.

TABLE 3

C1

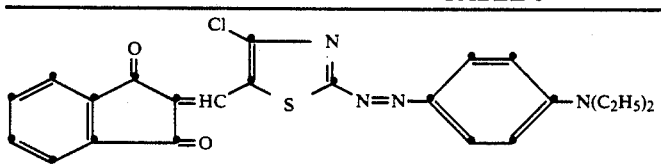

C2

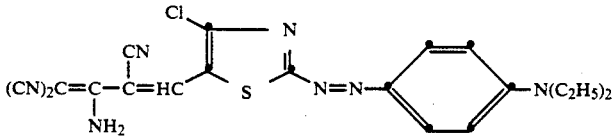

C3

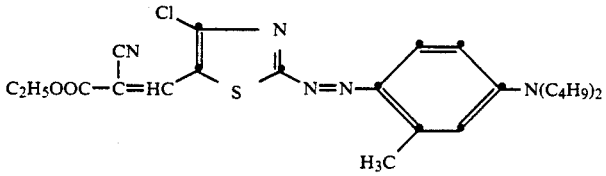

C4

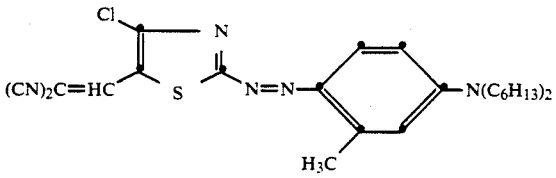

C5

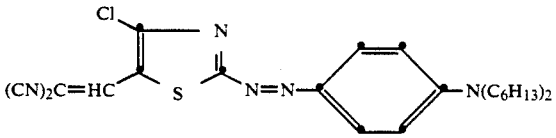

C6

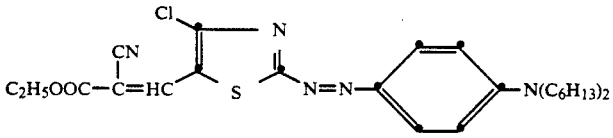

C7

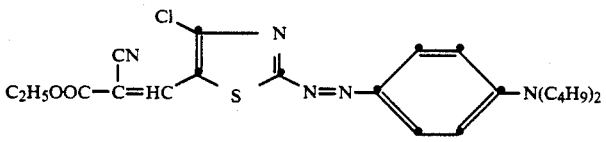

C8

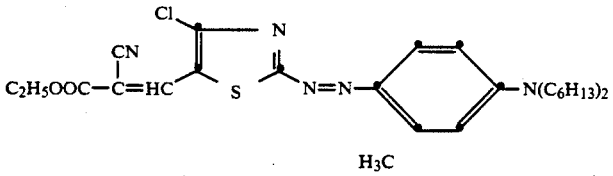

C9

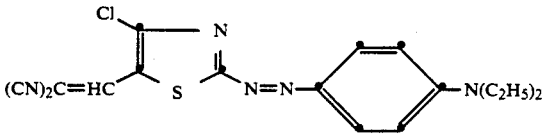

TABLE 3-continued
C10
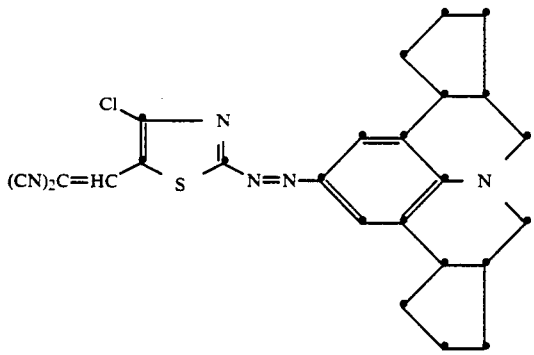
C11
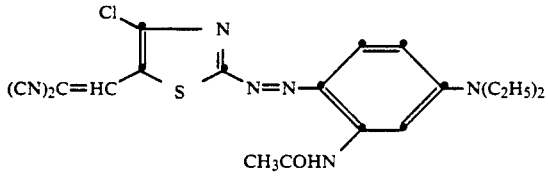
C12
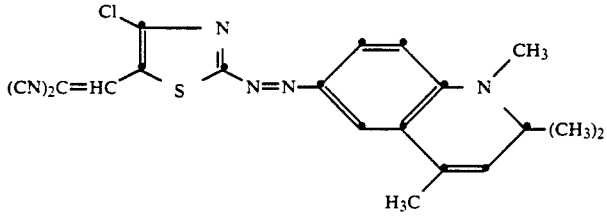
C13
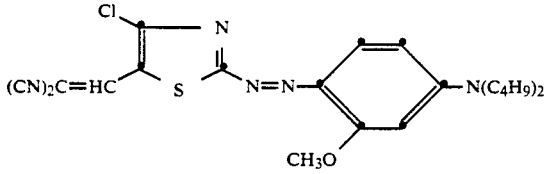
C14
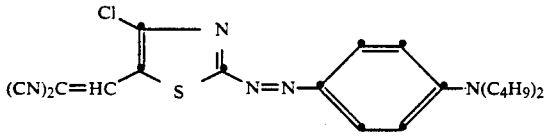
C15
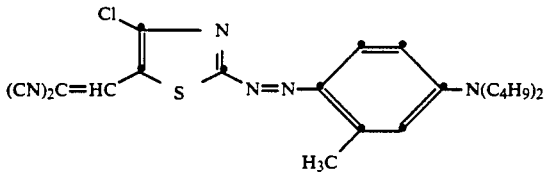
C16
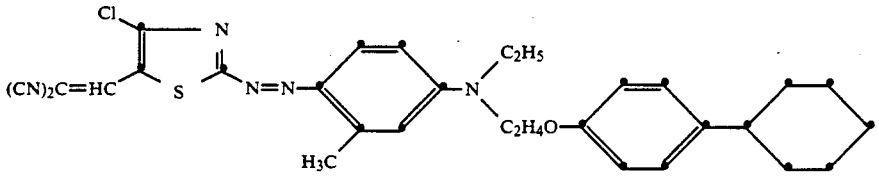

TABLE 3-continued
C17
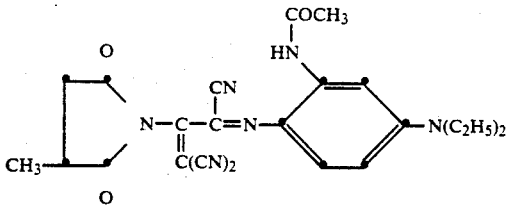
C18
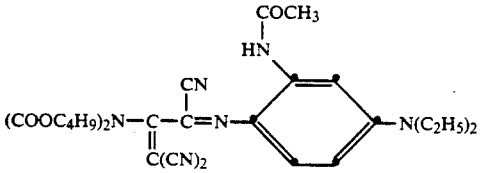
C19
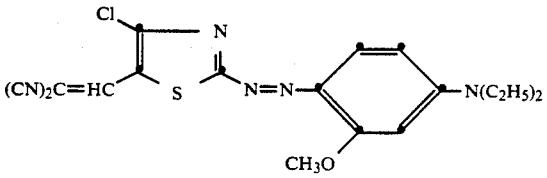
C20
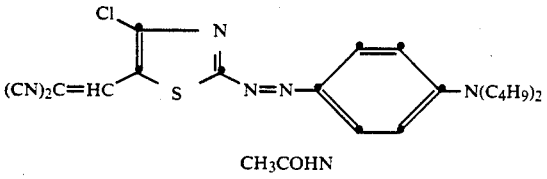
C21
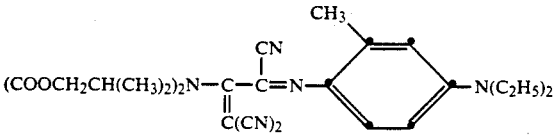
C22
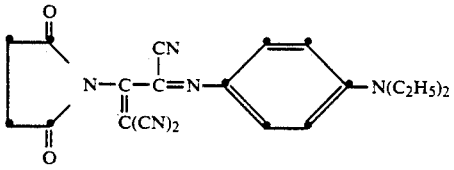
C23
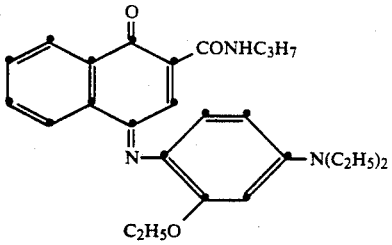
C24
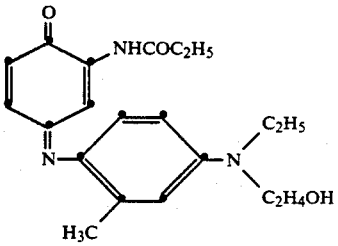

TABLE 3-continued
C25
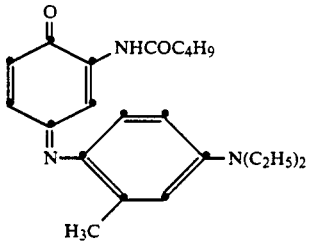
C26
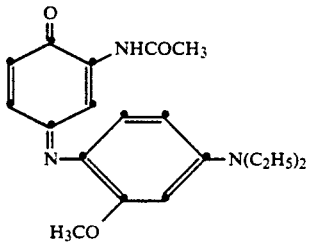
C27
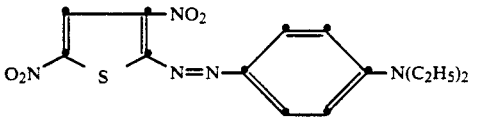
C28
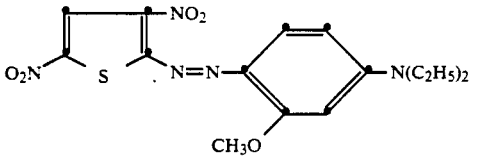
C29
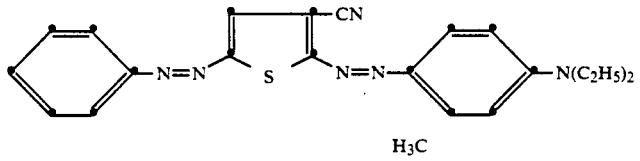
C30
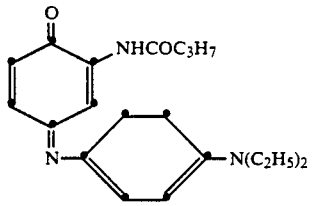
C31
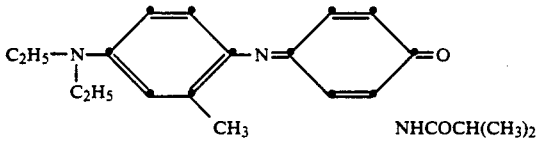
C32
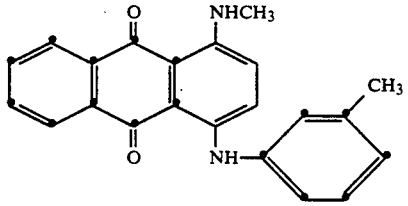

TABLE 3-continued
| | |
|---|---|
| 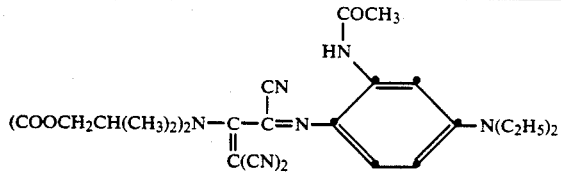 | C33 |
| 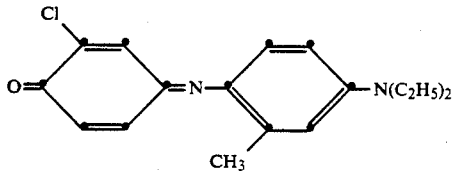 | C34 |
| 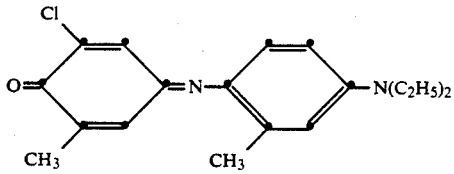 | C35 |
| 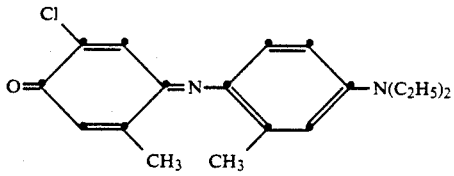 | C36 |
| 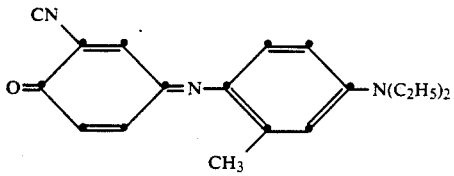 | C37 |
| 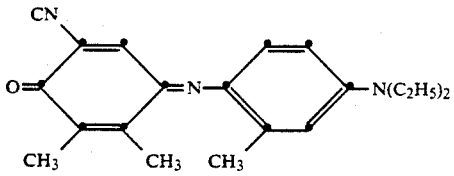 | C38 |
| 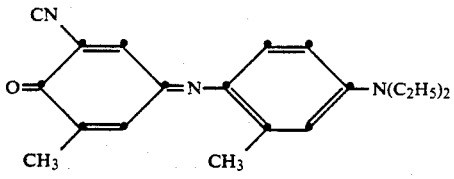 | C39 |
| 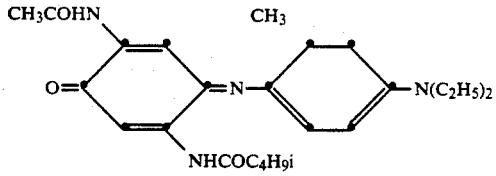 | C40 |
| 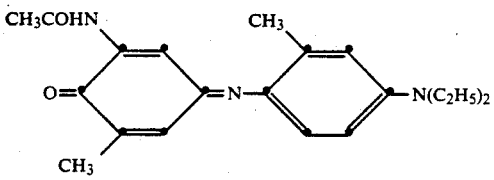 | C41 |

TABLE 3-continued
| | |
|---|---|
| 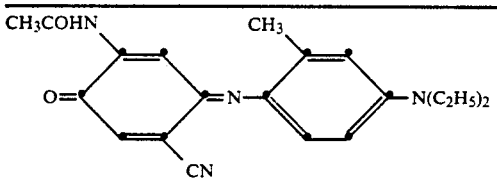 | C42 |
| 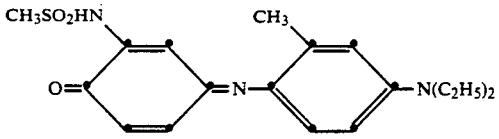 | C43 |
| 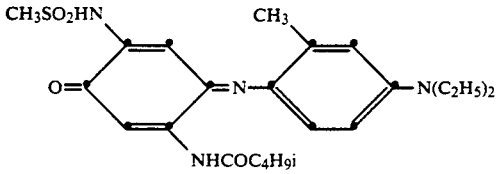 | C44 |
| 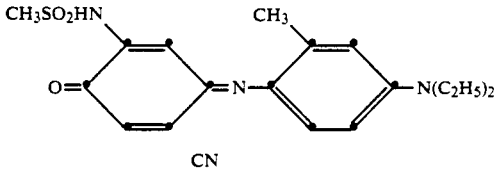 | C45 |
| 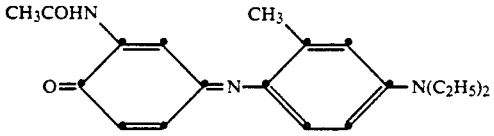 | C46 |
| 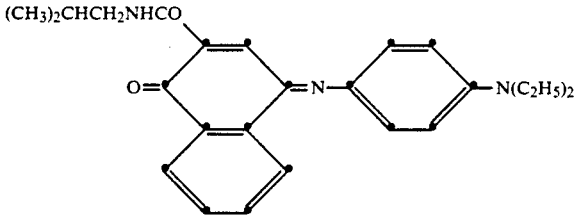 | C47 |
| 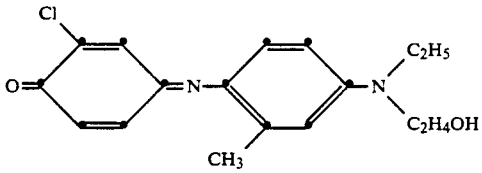 | C48 |
| 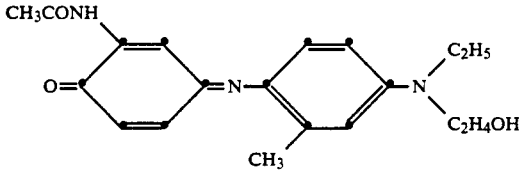 | C49 |
In table 4 are listed absorption maxima ($\lambda_{max}$) and extinction coefficients ($\epsilon$) of some of the cyan dyes listed in table 3 above in methanol.
TABLE 4
| | dye | $\lambda_{max}$ (nm) | $\epsilon$(1 mol$^{-1}$ cm$^{-1}$) |
|---|---|---|---|
| (a) | C9 | 635 | 68597 |
| (a) | C11 | 634 | 57239 |
TABLE 4-continued
| dye | $\lambda_{max}$ (nm) | $\epsilon$(1 mol$^{-1}$ cm$^{-1}$) |
|---|---|---|
| C12 | 678 | 40299 |
| C13 | 647 | 74198 |
| C14 | 642 | 71652 |

TABLE 4-continued

| dye | $\lambda_{max}$ (nm) | $\epsilon$(1 mol$^{-1}$ cm$^{-1}$) |
|---|---|---|
| C16 | 644 | 65797 |

(a) mixture methanol/dichloromethane 1:1 instead of methanol

Yellow dyes for use together with the magenta 4-chloro,5-formylthiazol-2-ylazoaniline dye in the formation of the black colored layer include the yellow dyes described in EP 400706, the yellow dyes described in European Patent Application no. 89203158.4, the yellow dyes described in European Patent Application no. 89203156.8, the yellow dyes described in European Patent Application no. 89203157.6 and the yellow dyes described in U.S. Pat. Nos. 4,816,435 and 4,833,123.

Preferred yellow dyes are arylazoaniline dyes.

Examples of suitable yellow dyes are listed in table 5.

TABLE 5

Y1

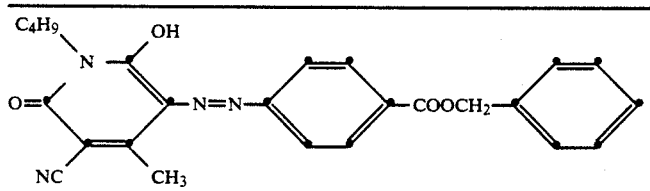

Y2

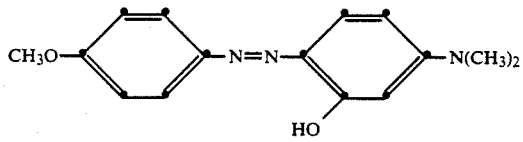

Y3

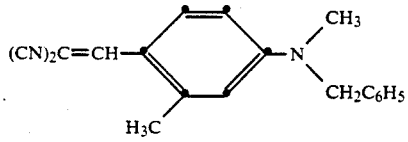

Y4

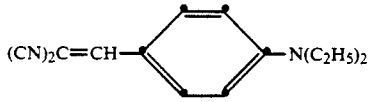

Y5

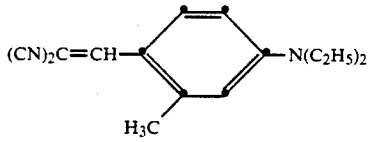

Y6

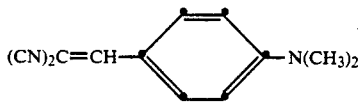

Y7

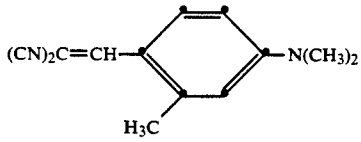

Y8

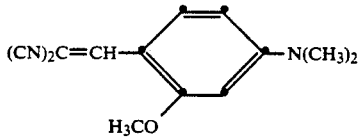

Y9

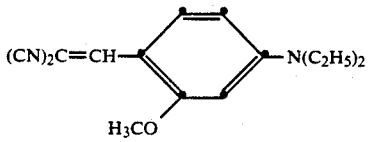

TABLE 5-continued
Y10
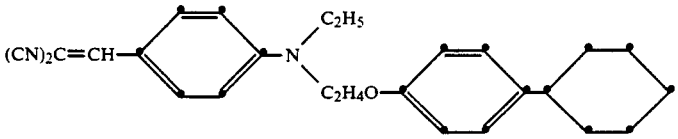
Y11
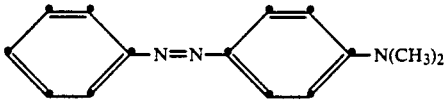
Y12
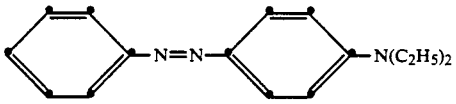
Y13
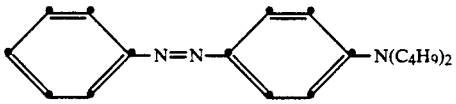
Y14
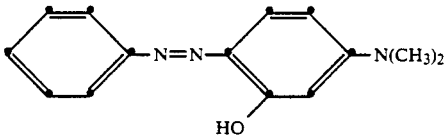
Y15
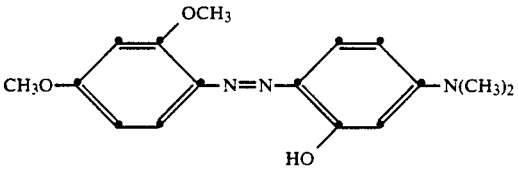
Y16
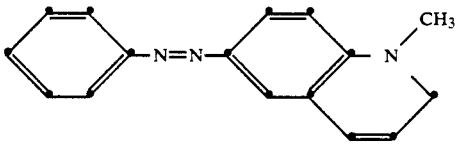
Y17
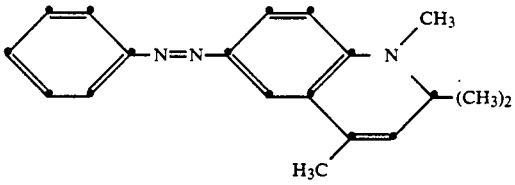
Y18
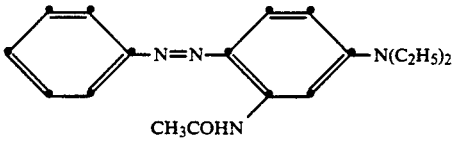
Y19
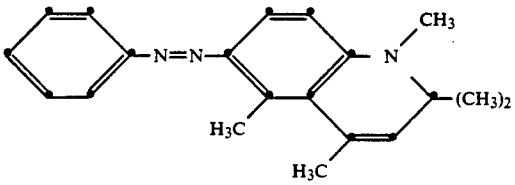

TABLE 5-continued
Y20
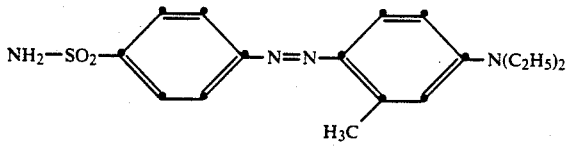
Y21
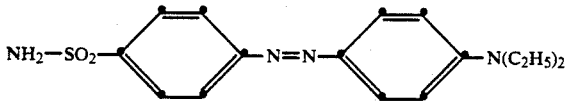
Y22
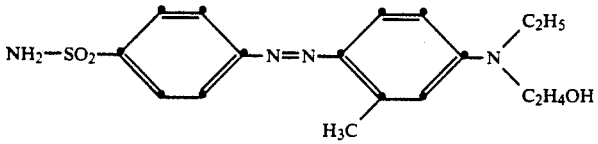
Y23
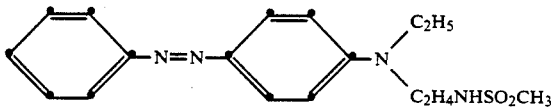
Y24
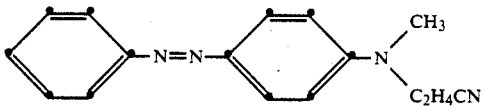
Y25
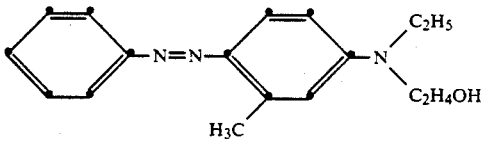
Y26
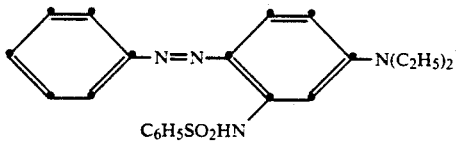
Y27
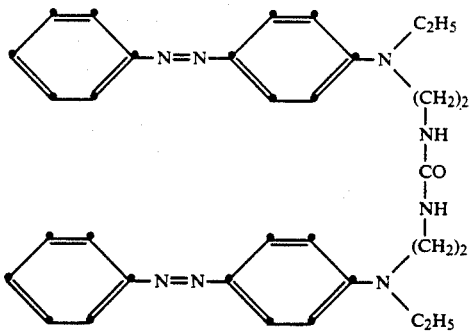
Y28
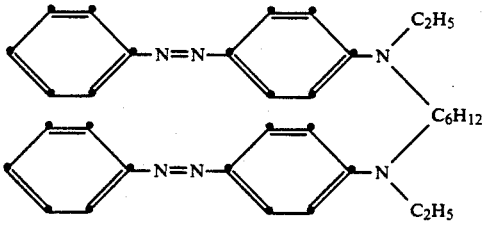

TABLE 5-continued

Y29

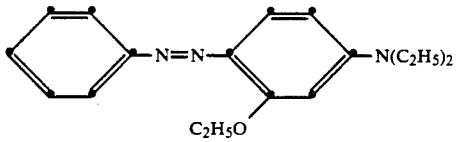

Y30

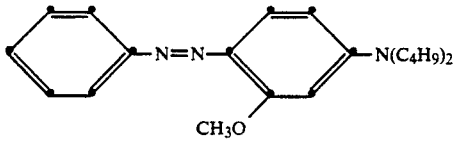

Y31

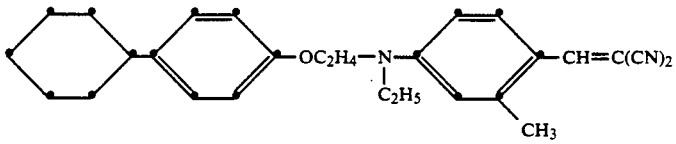

In compounding the dyes it is necessary to compound at least one magenta 4-chloro,5-formylthiazol-2-ylazoaniline dye, at least one cyan dye and at least one yellow dye. In other words, a single magenta, cyan and yellow dye may be used in the formation of the black colored layer or a mixture of one or more magenta dyes with one or more cyan dyes and with one or more yellow dyes may be used.

For example, the magenta 4-chloro,5-formylthiazol-2-ylazoaniline dye of the present invention can be used in admixture with a p-tricyanovinylaniline type magenta dye.

In a preferred embodiment of this invention the black colored layer is composed of the following combination of dyes: M11, C14 and Y2 or M11, C17 and Y15.

The present magenta 4-chloro,5-formylthiazol-2-yl dyes can be used in admixture with cyan and yellow dyes in the formation of a black colored dye-donor element for use in melt transfer. Preferably they are used in the black colored dye-donor element for use according to sublimation or diffusion transfer.

The black colored dye layer of such a thermal dye sublimation transfer donor element is formed preferably by adding the dyes, the polymeric binder medium, and other optional components to a suitable solvent or solvent mixture, dissolving or dispersing the ingredients to form a coating composition that is applied to a support, which may have been provided first with an adhesive or subbing layer, and dried.

The dye layer thus formed has a thickness of about 0.2 to 5.0 μm, preferably 0.4 to 2.0 μm, and the amount ratio of dye to binder is between 9:1 and 1:3 by weight, preferably between 2:1 and 1:2 by weight.

As polymeric binder the following can be used: cellulose derivatives, such as ethyl cellulose, hydroxyethyl cellulose, ethylhydroxy cellulose, ethylhydroxyethyl cellulose, hydroxypropyl cellulose, methyl cellulose, nitrocellulose, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; copolystyrene-acrylonitrile; polysulfones; polyphenylene oxide; organosilicones, such as polysiloxanes; epoxy resins and natural resins, such as gum arabic. Preferably cellulose acetate butyrate or copolystyrene-acrylonitrile is used as binder for the black colored dye layer of the present invention.

The black colored dye donor element of the present invention can be used for the recording of a black and white image. It can also be used for the recording of a colored image together with primary color dye-donor elements comprising respectively a magenta dye or a mixture of magenta dyes, a cyan dye or a mixture of cyan dyes and a yellow dye or a mixture of yellow dyes.

Any dye can be used in such a primary color dye layer provided it is easily transferable to the dye-image-receiving layer of the receiver sheet by the action of heat.

Typical and specific examples of primary color dyes for use in thermal dye sublimation transfer have been described in, e.g., European Patent Application no. 89201382.2, EP 209990, EP 209991, EP 216483, EP 218397, EP 227095, EP 227096, EP 229374, EP 235939, EP 247737, EP 257577, EP 257580, EP 258856, EP 279330, EP 279467, EP 285665, U.S. Pat. Nos. 4,743,582, 4,753,922, 4,753,923, 4,757,046, 4,769,360, 4,771,035, JP 84/78894, JP 84/78895, JP 84/78896, JP 84/227490, JP 84/227948, JP 85/27594, JP 85/30391, JP 85/229787, JP 85/229789, JP 85/229790, JP 85/229791, JP 85/229792, JP 85/229793, JP 85/229795, JP 86/41596, JP 86/268493, JP 86/268494, JP 86/268495 and JP 86/284489.

Particularly preferred dyes or dye mixtures for use in the primary color dye-donor elements are for yellow a mixture of a dye corresponding to the formula

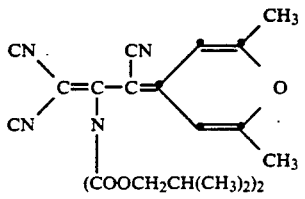

and a dye corresponding to the formula

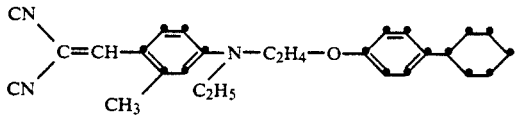

in a ratio of 1:10 to 10:1, for magenta a mixture of a dye corresponding to the formula

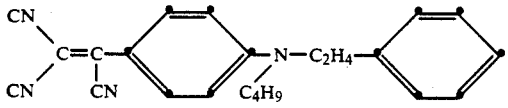

and a dye corresponding to the formula

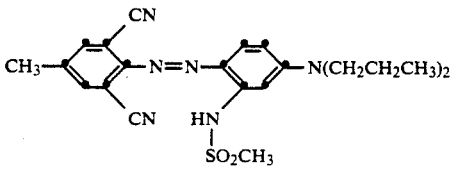

in a ratio of 1:10 to 10:1, or a mixture of a dye corresponding to the formula

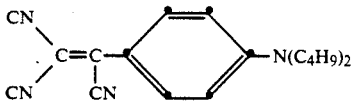

and a dye corresponding to the formula

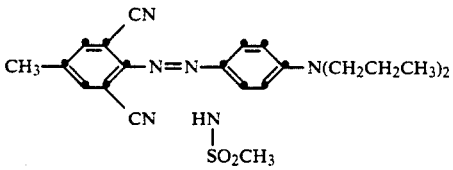

in a ratio of 1:10 to 10:1, and for cyan a mixture of a dye corresponding to the formula

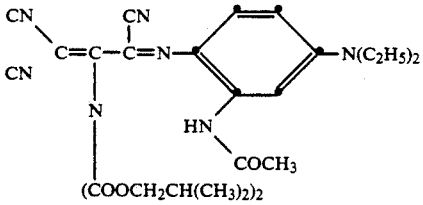

and a dye corresponding to the formula

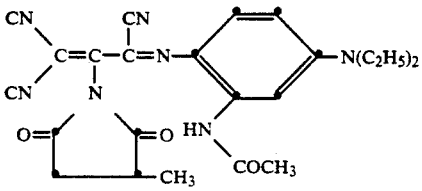

in a ratio of 1:10 to 10:1. The binder that is preferably used in said primary color dye layers is a mixture of co-styrene-acrylonitrile and co-styrene-acrylonitrile-butadieen in a ratio ranging from 0 to 100% of either of the constituents. Preferably the binder/dye ratio is between 5:1 and 1:5.

The coating layer may also contain other additives, such as curing agents, preservatives, organic or inorganic fine particles, dispersing agents, antistatic agents, defoaming agents, viscosity controlling agents, etc., these and other ingredients being described more fully in EP 133011, EP 133012, EP 111004 and EP 279467.

Any material can be used as the support for the dye-donor element provided it is dimensionally stable and capable of withstanding the temperatures involved, up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, the support has a thickness of 2 to 30 μm. The support may also be coated with an adhesive or subbing layer, if desired.

The dye layer of the dye-donor element may be coated on the support or printed thereon by a printing technique such as a gravure process.

A dye-barrier layer comprising a hydrophilic polymer may also be employed in the dye-donor element between its support and the dye layer to improve the dye transfer densities by preventing wrong-way transfer of dye towards the support. The dye barrier layer may contain any hydrophilic material which is useful for the intended purpose. In general, good results have been obtained with gelatin, polyacryl amide, polyisopropyl acrylamide, butyl methacrylate grafted gelatin, ethyl methacrylate grafted gelatin, ethyl acrylate grafted gelatin, cellulose monoacetate, methyl cellulose, polyvinyl alcohol, polyethylene imine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable dye barrier layers have been described in e.g. EP 227091 and EP 228065. Certain hydrophilic polymers, for example those described in EP 227091, also have an adequate adhesion to the support and the dye layer, thus eliminating the need for a separate adhesive or subbing layer. These particular hydrophilic polymers used in a single layer in the donor element thus perform a dual function, hence are referred to as dye-barrier/-subbing layers.

Preferably the reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layers are described in e.g. EP 138483, EP 227090, U.S. Pat. Nos. 4,567,113, 4,572,860, 4,717,711. Preferably the slipping layer comprises as binder a styrene-acrylonitrile copolymer or a styrene-acrylonitrile-butadiene copolymer or a mixture hereof and as lubricant in an amount of 0.1 to 10% by weight of the binder (mixture) a polysiloxane-polyether copolymer or polytetrafluoroethylene or a mixture hereof.

The support for the receiver sheet that is used with the dye-donor element may be a transparent film of e.g. polyethylene terephthalate, a polyether sulfone, a polyimide, a cellulose ester or a polyvinyl alcohol-co-acetal. The support may also be a reflective one such as baryta-coated paper, polyethylene-coated paper or white polyester i.e. white-pigmented polyester. Blue-colored polyethylene terephthalate film can also be used as support.

To avoid poor adsorption of the transferred dye to the support of the receiver sheet this support must be coated with a special surface, a dye-image-receiving layer, into which the dye can diffuse more readily. The dye-image-receiving layer may comprise, for example, a polycarbonate, a polyurethane, a polyester, a polyamide, polyvinyl chloride, polystyrene-co-acrylonitrile, polycaprolactone or mixtures thereof. Suitable dye-receiving layers have been described in e.g. EP 133011, EP 133012, EP 144247, EP 227094, EP 228066.

In order to improve the light resistance and other stabilities of recorded images, UV absorbers, singlet oxygen quenchers such as HALS-compounds (Hindered Amine Light Stabilizers) and/or antioxidants may be incorporated into the receiving layer.

The dye layer of the dye-donor element or the dye-image-receiving layer of the receiver sheet may also contain a releasing agent that aids in separating the dye-donor element from the dye-receiving element after transfer. The releasing agents can also be applied in a separate layer on at least part of the dye layer or of the receiving layer. For the releasing agent solid waxes, fluorine- or phosphate-containing surfactants and silicone oils are used. Suitable releasing agents are described in e.g. EP 133012, JP 85/19138, EP 227092.

The dye-donor elements according to the invention are used to form a dye transfer image. Such a process comprises placing the dye layer of the donor element in face-to-face relation with the dye-receiving layer of the receiver sheet and imagewise heating from the back of the donor element. The transfer of the dye is accomplished by heating for about several milliseconds at a temperature of 400° C.

When the process is performed for but one single color, a monochrome dye transfer image is obtained. A multicolor image can be obtained by using a donor element containing three or more primary color dyes and sequentially performing the process steps described above for each color. The above sandwich of donor element and receiver sheet is formed on three occasions during the time when heat is applied by the thermal printing head. After the first dye has been transferred, the elements are peeled apart. A second dye-donor element (or another area of the donor element with a different dye area) is then brought in register with the dye-receiving element and the process repeated. The third color and optionally further colors are obtained in the same manner.

In order to accomplish a perfect register when the process is performed for more than one color and in order to detect what color is existing at the printing portion of the donor element, detection marks are commonly provided on one surface of the donor element. Generally optically detectable marks are used that can be detected by a light source and a photo sensor; detection be done by measuring the light transmitted through the detection mark or reflected from said mark. The marks being in the form of a light-absorbing or light-reflecting coating are formed in a preassigned position on the donor element by e.g. gravure printing. The detection marks can comprise an infrared shielding compound such as carbon black. The detection mark can also comprise one of the image dyes that are used for the image formation, with the detection being in the visible range.

The receiving element can also have detection marks provided on one surface, preferably the back surface so that the receiving element can be accurately set at a desired position during transfer, whereby the image can be formed always at a correct desired position.

In addition to thermal heads, laser light, infrared flash or heated pens can be used as the heat source for supplying heat energy. Thermal printing heads that can be used to transfer dye from the dye-donor elements of the present invention to a receiver sheet are commercially available. In case laser light is used, the dye layer or another layer of the dye element has to contain a compound that absorbs the light emitted by the laser and converts it into heat, e.g. carbon black.

Alternatively, the support of the dye-donor element may be an electrically resistive ribbon consisting of, for example, a multi-layer structure of a carbon loaded polycarbonate coated with a thin aluminum film. Current is injected into the resistive ribbon by electrically addressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology compared to the thermal head technology where the various elements of the thermal head get hot and must cool down before the head can move to the next printing position.

The black dye-donor elements according to the present invention are preferably used in a monochrome black thermal sublimation transfer process for obtaining a hard copy of a medical diagnostic image preferably on a transparent or blue-colored support.

The following examples are provided to illustrate the invention in more detail without limiting, however, the scope thereof.

EXAMPLE A

A dye-donor element for use according to thermal dye sublimation transfer was prepared as follows:

A solution comprising 50 mg of dye as identified below and 50 mg of cellulose acetate propionate as binder in 10 ml of 2-butanone as solvent was prepared. From this solution a layer having a wet thickness of 100 μm was coated on 6 μm thick polyethylene terephthalate film. The resulting layer was dried by evaporation of the solvent.

A commercially available Hitachi material type VY T50A (transparent film) was used as receiving element.

The dye-donor element was printed in combination with the receiving element in a Hitachi color video printer VY-100A.

The receiver sheet was separated from the dye-donor element and the color density of the recorded image on the receiving sheet was measured at the wavelength of maximum density ($D_{max}$), at 595 nm ($D_1$) and at 555 nm ($D_2$) by means of a Match-Scan Recording spectrophotometer.

This experiment was repeated for each of the dyes identified in table 6. This experiment was also repeated with two image dyes (dye 24 and dye 25) as comparison.

The results are shown in table 6.

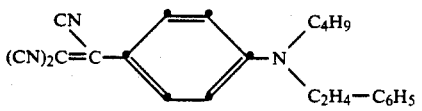

Dye 24

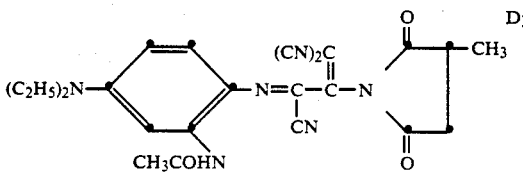

Dye 25

TABLE 6

| Dye | $D_{max}$ | $D_1$ | $D_2$ | $D_{max}/2$ | $(D_1 + D_2)/D_{max}$ |
|---|---|---|---|---|---|
| Dye 1 | 148 | 144 | 118 | 74 | 1.78 |
| Dye 2 | 124 | 116 | 118 | 62 | 1.88 |
| Dye 3 | 135 | 116 | 134 | 67.5 | 1.85 |
| Dye 4 | 149 | 108 | 144 | 74.5 | 1.69 |
| Dye 5 | 157 | 100 | 147 | 78.5 | 1.57 |
| Dye 6 | 142 | 125 | 141 | 71 | 1.87 |
| Dye 7 | 120 | 92 | 104 | 60 | 1.63 |
| Dye 8 | 150 | 142 | 148 | 75 | 1.93 |
| Dye 9 | 154 | 144 | 152 | 77 | 1.92 |
| Dye 10 | 156 | 130 | 155 | 78 | 1.83 |
| Dye 11 | 153 | 152 | 90 | 76.5 | 1.58 |
| Dye 12 | 122 | 122 | 85 | 61 | 1.70 |
| Dye 13 | 155 | 146 | 135 | 77.5 | 1.81 |
| Dye 14 | 125 | 117 | 75 | 62.5 | 1.52 |
| Dye 15 | 154 | 154 | 125 | 77 | 1.81 |
| Dye 16 | 148 | 145 | 100 | 74 | 1.66 |
| Dye 17 | 143 | 143 | 96 | 71.5 | 1.67 |
| Dye 18 | 152 | 151 | 110 | 76 | 1.72 |
| Dye 19 | 154 | 121 | 152 | 77 | 1.77 |
| Dye 20 | 150 | 149 | 124 | 75 | 1.82 |
| Dye 21 | 135 | 134 | 114 | 67.5 | 1.84 |
| Dye 22 | 141 | 120 | 137 | 70.5 | 1.82 |
| Dye 23 | 150 | 136 | 140 | 75 | 1.84 |
| Dye 24 | 153 | 20 | 110 | 76.5 | 0.85 |
| Dye 25 | 155 | 114 | 56 | 77.5 | 1.10 |

EXAMPLE B

A black colored dye-donor element for use according to thermal dye sublimation transfer was prepared as follows:

A solution comprising 40 mg of 4-chloro,5-formylthiazol-2-ylazoaniline magenta dye according to the present invention, 25 mg of cyan dye, 25 mg of yellow dye (the nature of the magenta, cyan and yellow dye being defined below), 30 mg of decanediol as thermal solvent and 50 mg of cellulose acetate propionate as binder in 10 ml of 2-butanone as solvent was prepared. From this solution a layer having a wet thickness of 100 μm was coated on 6 μm thick polyethylene terephthalate film. The resulting layer was dried by evaporation of the solvent.

A commercially available Hitachi material type VY T50A (transparant film) was used as receiving element.

The dye-donor element was printed in combination with the receiving element in a Hitachi color video printer VY-100A.

The receiver sheet was separated from the dye-donor element and the color density of the recorded black image on the receiving sheet in the red ($D_r$), green ($D_g$) and blue ($D_b$) region was measured by means of a Macbeth Quanta Log densitometer.

This experiment was repeated for each of the dye mixtures identified in table 7. As a result thereof black colored records of color densities shown in table 7 were obtained.

Instead of cellulose acetate propionate the following binders can be used: co-vinyl-n-butyral-vinylacetal-vinylalcohol (a), co-acrylonitrile-styrene (b), cellulose acetate butyrate (c), polyvinylchloride-vinylacetate (d), nitrocellulose (e).

TABLE 7

| Example no. | Magenta dye | Cyan dye | Yellow dye | $D_r$ | $D_g$ | $D_b$ |
|---|---|---|---|---|---|---|
| 1 | M3 | C17 | Y2 | 130 | 190 | 200 |
| 2 | M3 | C9 | Y2 | 134 | 200 | 214 |
| 3 (a) | M3 | C17 | Y2 | 122 | 167 | 170 |
| 4 (b) | M3 | C17 | Y2 | 112 | 160 | 171 |
| 5 (c) | M3 | C17 | Y2 | 114 | 178 | 179 |
| 6 (d) | M3 | C17 | Y2 | 111 | 170 | 181 |
| 7 (e) | M3 | C17 | Y2 | 94 | 145 | 165 |
| 8 (f) | M11 | C31 | Y31 | 173 | 241 | 162 |
| 9 | M3 | C32 | Y31 | 108 | 260 | 159 |
| 10 | M9 | C32 | Y31 | 120 | 202 | 158 |
| 11 | M4 | C32 | Y31 | 92 | 192 | 151 |
| 12 (f) | M11 | C18 | Y2 | 176 | 248 | 261 |
| 13 (f) | M3 | C1 | Y2 | 187 | 206 | 250 |
| 14 (f) | M3 | C15 | Y2 | 222 | 235 | 270 |
| 15 (f) | M3 | C14 | Y2 | 241 | 250 | 297 |
| 16 (f) | M3 | C18 | Y2 | 179 | 215 | 296 |
| 17 (f) | M11 | C1 | Y2 | 220 | 277 | 304 |
| 18 (f) | M11 | C15 | Y2 | 224 | 273 | 310 |
| 19 (f) | M11 | C14 | Y2 | 251 | 299 | 298 |
| 20 (f) | M11 | C18 | Y2 | 190 | 301 | 311 |
| 21 (f) | M9 | C1 | Y2 | 206 | 225 | 258 |
| 22 (f) | M9 | C15 | Y2 | 233 | 246 | 285 |
| 23 (f) | M9 | C14 | Y2 | 230 | 236 | 281 |
| 24 (f) | M9 | C18 | Y2 | 189 | 243 | 272 |
| 25 (f) | M8 | C1 | Y2 | 208 | 263 | 291 |
| 26 (f) | M8 | C15 | Y2 | 212 | 266 | 289 |
| 27 (f) | M8 | C14 | Y2 | 222 | 259 | 277 |
| 28 (f) | M8 | C18 | Y2 | 185 | 269 | 280 |
| 29 (b)(f) | M11 | C46 | Y15 | 188 | 253 | 224 |
| 30 (b)(f) | M11 | C47 | Y15 | 143 | 178 | 183 |
| 31 (b)(f) | M11 | C34 | Y15 | 191 | 238 | 217 |

(f) printed on Mitsubishi CK100TS transparent receiver in a Mitsubishi CP100E printer

COMPARATIVE EXAMPLES

Preparation of black colored dye-donor elements was practiced in the same manner as in examples 1–31 above using magenta dyes of the type shown below in place of the magenta 4-chloro,5-formylthiazol-2-ylazoaniline dyes of the present invention used in examples 1–31.

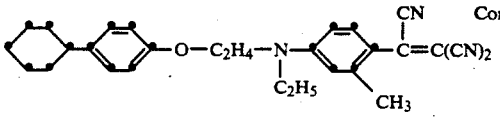

Comp. M1

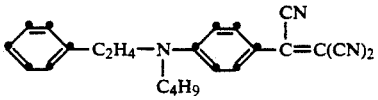

Comp. M2

-continued

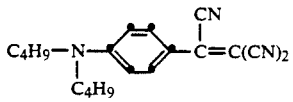

Comp. M3

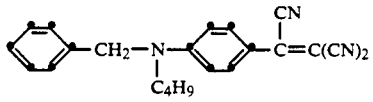

Comp. M4

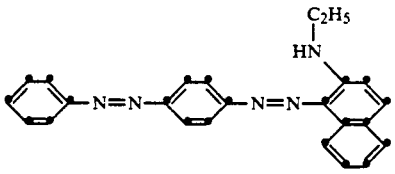

Comp. M5

As a first series of comparative examples black colored dye-donor elements were prepared as described in examples 1-31 with the exception that a mixture of magenta, cyan and yellow dyes as described in U.S. Pat. No. 4,816,435 was used. The measured color densities are listed below in table 8.

TABLE 8

| Example no. | Magenta dye | Cyan dye | Yellow dye | $D_r$ | $D_g$ | $D_b$ |
|---|---|---|---|---|---|---|
| Comp. 1 | Comp. M1 | C31 | Y31 | 68 | 74 | 75 |
| Comp. 2 | Comp. M2 | C31 | Y31 | 64 | 112 | 87 |
| Comp. 3 | Comp. M3 | C31 | Y31 | 70 | 155 | 108 |
| Comp. 4 | Comp. M4 | C31 | Y31 | 66 | 118 | 101 |

Considerable lower densities are obtained than in example 8 where the same cyan and yellow dyes are used but with the magenta dye of the present invention.

As a second series of comparative examples a black colored dye-donor element containing the mixture of magenta, cyan and yellow dyes comprised in the commercially available black colored dye-donor element CK100BS supplied by Mitsubishi was prepared as described above in examples 1-31 and printed on Mitsubishi CK100TS transparent film receiver in a Mitsubishi CP100E printer. The color densities obtained are listed in table 9.

TABLE 9

| Example no. | Magenta dye | Cyan dye | Yellow dye | $D_r$ | $D_g$ | $D_b$ |
|---|---|---|---|---|---|---|
| Comp. 5 | Comp. M5 | C32 | Y31 | 55 | 161 | 155 |

Considerable lower densities are obtained than in examples 9-11 where the same cyan and yellow dyes are used but with magenta dyes of the present invention, especially in the red and green region.

As a third series of comparative examples black colored dye-donor elements were prepared as described above with the difference that other types of magenta dyes were used. The obtained color densities are listed in table 10.

TABLE 10

| Example no. | Magenta dye | Cyan dye | Yellow dye | $D_r$ | $D_g$ | $D_b$ |
|---|---|---|---|---|---|---|
| Comp. 6 | Comp. M1 | C17 | Y2 | 75 | 66 | 161 |
| Comp. 7 | Comp. M3 | C18 | Y2 | 53 | 151 | 136 |
| Comp. 8 | Comp. M1 | C18 | Y2 | 51 | 69 | 161 |

TABLE 10-continued

| Example no. | Magenta dye | Cyan dye | Yellow dye | $D_r$ | $D_g$ | $D_b$ |
|---|---|---|---|---|---|---|
| Comp. 9 | Comp. M3 | C9 | Y2 | 31 | 172 | 192 |

Considerable lower densities are obtained than in examples 1, 12 and 2 respectively where the same cyan and yellow dyes are used but with magenta dyes of the present invention.

We claim:

1. Black colored dye-donor element for use according to thermal dye sublimation transfer comprising a support having thereon a dye layer containing a yellow dye and another dye each capable of being transferred to a receiving element, the densities of a transferred pixel of said other dye satisfying the following equations:

$$\frac{D_1 + D_2}{D_{max}} \geqq 1.5 \text{ and } D_1 \geqq \frac{D_{max}}{2} \text{ and } D_2 \geqq \frac{D_{max}}{2}$$

wherein $D_{max}$ is the density at the wavelength of maximum density, $D_1$ is the density at 595 nm and $D_2$ is the density at 555 nm.

2. Black colored dye-donor element according to claim 1, wherein $(D_1+D_2)/D_{max}$ is at least 1.6.

3. Black colored dye-donor element according to claim 1, wherein said dye is a magenta 4-chloro,5-formylthiazol-2-ylazoaniline dye.

4. Black colored dye-donor element according to claim 3, wherein said 4-chloro,5-formylthiazol-2-ylazoaniline dye corresponds to the following formula

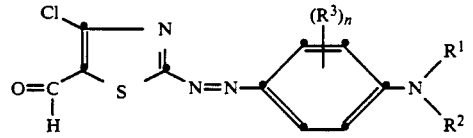

wherein:

$R^1$ and $R^2$ each independently represent hydrogen, a substituted or unsubstituted alkyl group, a substituted or unsubstituted cycloalkyl group, a substituted or unsubstituted aryl group, a substituted or unsubstituted allyl group, a substituted or unsubstituted alkenyl group, or $R^1$ and $R^2$ together with the nitrogen to which they are attached form the necessary atoms to close a 5- or 6-membered heterocyclic ring, or $R^1$ and/or $R^2$ together with the nitrogen to which they are attached and either or both carbon atoms of the phenyl ring ortho to said nitrogen atom form a 5- or 6-membered heterocyclic ring;

$R^3$ represents a halogen atom, a hydroxy group, a cyano group, a substituted or unsubstituted alkyl group, a substituted or unsubstituted cycloalkyl group, a substituted or unsubstituted aryl group, a substituted or unsubstituted alkoxy group, a substituted or unsubstituted aryloxy group, a substituted or unsubstituted alkylthio group, a substituted or unsubstituted arylthio group, a substituted or unsubstituted amino group, a substituted or unsubstituted alkylcarbonylamino group, a substituted or unsubstituted arylcarbonylamino group, a substituted or unsubstituted alkylsulfonylamino group, a substituted or unsubstituted arylsulfonylamino group, a substituted or unsubstituted alkoxycarbonylamino group, a substituted or unsubstituted aryloxycarbonylamino group, a substituted or unsubstituted alkylthiocarbonylamino group, a substituted or unsubstituted arylthiocarbonylamino group, a substituted or unsubstituted alkylphosphoramidate group, a substituted or unsubstituted arylphosphoramidate group, a substituted or unsubstituted alkylphosphonamidate group, a substituted or unsubstituted arylphosphonamidate group;

n represents 0, 1, 2, 3 or 4; the $R^3$ substituents may be the same or different when n is greater than 1.

5. Black colored dye-donor element according to claim 4, wherein $R^1$ and $R^2$ (same or different) represent a $C_1$–$C_6$ alkyl group and n represents 0 or 1 with $R_3$ representing alkyl or alkoxy or amino or alkylcarbonylamino in ortho position to the azo link.

6. Black colored dye-donor element according to claim 3, wherein said magenta dye has an absorption maxima in the range of from 520 to 600 nm.

7. Black colored dye-donor element according to claim 3, wherein said dye layer further comprises at least one cyan dye.

8. Black colored dye-donor element according to claim 7, wherein the compounding ratio of the dyes is 20 to 80% by weight for the magenta dye, 10 to 40% by weight for the cyan dye and 10 to 40% by weight for the yellow dye.

9. Black colored dye-donor element according to claim 8, wherein the compounding ratio of the dyes is 30 to 60% by weight for the magenta dye, 20 to 40% by weight for the cyan dye and 10 to 30% by weight for the yellow dye.

10. Black colored dye-donor element according to claim 7, wherein at least one of the cyan dyes corresponds to the following formula

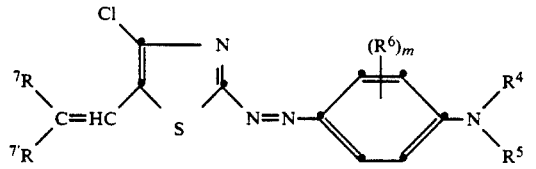

wherein:

$R^4$ and $R^5$ each independently represent hydrogen, a substituted or unsubstituted alkyl group, a substituted or unsubstituted cycloalkyl group, a substituted or unsubstituted aryl group, a substituted or unsubstituted allyl group, a substituted or unsubstituted alkenyl group, or $R^4$ and $R^5$ together with the nitrogen to which they are attached form the necessary atoms to close a 5- or 6-membered heterocyclic ring, or $R^4$ and/or $R^5$ together with the nitrogen to which they are attached and either or both carbon atoms of the phenyl ring ortho to said nitrogen atom form a 5- or 6-membered heterocyclic ring;

$R^6$ represents a halogen atom, a hydroxy group, a cyano group, a substituted or unsubstituted alkyl group, a substituted or unsubstituted cycloalkyl group, a substituted or unsubstituted aryl group, a substituted or unsubstituted alkoxy group, a substituted or unsubstituted aryloxy group, a substituted or unsubstituted alkylthio group, a substituted or unsubstituted arylthio group, a substituted or unsubstituted amino group, a substituted or unsubstituted alkylcarbonylamino group, a substituted or unsubstituted arylcarbonylamino group, a substituted or unsubstituted alkylsulfonylamino group, a substituted or unsubstituted arylsulfonylamino group, a substituted or unsubstituted alkoxycarbonylamino group, a substituted or unsubstituted aryloxycarbonylamino group, a substituted or unsubstituted alkylthiocarbonylamino group, a substituted or unsubstituted arylthiocarbonylamino group, a substituted or unsubstituted alkylphosphoramidate group, a substituted or unsubstituted arylphosphoramidate group, a substituted or unsubstituted alkylphosphonamidate group, a substituted or unsubstituted arylphosphonamidate group;

m represents 0, 1, 2, 3 or 4; the $R^6$ substituents may be the same or different when m is greater than 1;

$R^7$ and $R^{7'}$ each independently represent a cyano group, a substituted or unsubstituted alkoxycarbonyl group, a substituted or unsubstituted alkenyloxycarbonyl group, a substituted or unsubstituted aryloxycarbonyl group, a substituted or unsubstituted alkylaminocarbonyl group, a substituted or unsubstituted arylaminocarbonyl group, a substituted or unsubstituted alkylcarbonyl group, a substituted or unsubstituted arylcarbonyl group, a substituted or unsubstituted alkylsulfonyl group, a substituted or unsubstituted arylsulfonyl group, or $R^7$ and $R^{7'}$ together with the carbon to which they are attached form the necessary atoms to close a 5- or 6-membered ring including a 5- or 6-membered heterocyclic ring.

11. Black colored dye-donor element according to claim 10, wherein $R^7$ and $R^{7'}$ each represent a cyano group and $R^4$ and $R^5$ (same or different) represent a $C_1$–$C_6$ alkyl group and m represents 0 or 1 with $R^6$ being alkyl or alkoxy or amino or alkylcarbonylamino.

12. Black colored dye-donor element according to claim 7, wherein at least one of the cyan dyes corresponds to the following formula

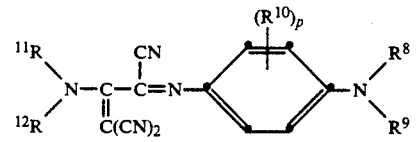

wherein:

$R^8$ and $R^9$ each independently represent hydrogen, a substituted or unsubstituted alkyl group, a substituted or unsubstituted cycloalkyl group, a substituted or unsubstituted aryl group, a substituted or unsubstituted allyl group, a substituted or unsubstituted alkenyl group, or $R^8$ and $R^9$ together with the nitrogen to which they are attached form the necessary atoms to close a 5- or 6-membered heterocyclic ring, or $R^8$ and/or $R^9$ together with the nitrogen to which they are attached and either or both carbon atoms of the phenyl ring ortho to said nitrogen atom form a 5- or 6-membered heterocyclic ring;

$R^{10}$ represents a halogen atom, a hydroxy group, a cyano group, a substituted or unsubstituted alkyl group, a substituted or unsubstituted cycloalkyl group, a substituted or unsubstituted aryl group, a substituted or unsubstituted alkoxy group, a substituted or unsubstituted aryloxy group, a substituted or unsubstituted alkylthio group, a substituted or unsubstituted arylthio group, a substituted or unsubstituted amino group, a substituted or unsubstituted alkylcarbonylamino group, a substituted or unsubstituted arylcarbonylamino group, a substituted or unsubstituted alkylsulfonylamino group, a substituted or unsubstituted arylsulfonylamino group, a substituted or unsubstituted alkoxycarbonylamino group, a substituted or unsubstituted aryloxycarbonylamino group, a substituted or unsubstituted alkylthiocarbonylamino group, a substituted or unsubstituted arylthiocarbonylamino group, a substituted or unsubstituted alkylphosphoramidate group, a substituted or unsubstituted arylphosphoramidate group, a substituted or unsubstituted alkylphosphonamidate group, a substituted or unsubstituted arylphosphonamidate group;

p represents 0, 1, 2, 3 or 4; the $R^{10}$ substituents may be the same or different when p is greater than 1;

$R^{11}$ and $R^{12}$ each independently represents hydrogen, substituted or unsubstituted alkyl, substituted or unsubstituted cycloalkyl, substituted or unsubstituted aryl, substituted or unsubstituted alkylsulfonyl, substituted or unsubstituted arylsulfonyl, substituted or unsubstituted alkylsulfonylamino, substituted or unsubstituted arylsulfonylamino, substituted or unsubstituted alkylcarbonyl, substituted or unsubstituted alkoxycarbonyl, substituted or unsubstituted alkylthio, or $R^{11}$ and $R^{12}$ together with the nitrogen to which they are attached represent the necessary atoms to close a heterocyclic nucleus or substituted heterocyclic nucleus, including a heterocyclic nucleus with an aliphatic or aromatic ring fused-on.

13. Black colored dye-donor element according to claim 12, wherein $R^{11}$ and $R^{12}$ each represent alkoxycarbonyl or alkylsulfonylamino or $R^{11}$ and $R^{12}$ together with the nitrogen to which they are attached represent succinimido and $R^8$ and $R^9$ (same or different) represent a $C_1$-$C_6$ alkyl group and p represents 0 or 1 with $R^{10}$ being alkylcarbonylamino or alkyl.

14. Black colored dye-donor element according to claim 7, wherein at least one of the cyan dyes corresponds to the following formula

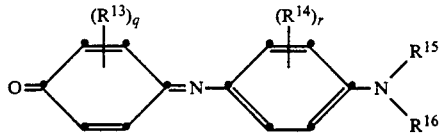

wherein:

$R^{14}$ represents a halogen atom, a hydroxy group, a cyano group, a substituted or unsubstituted alkyl group, a substituted or unsubstituted cycloalkyl group, a substituted or unsubstituted aryl group, a substituted or unsubstituted alkoxy group, a substituted or unsubstituted aryloxy group, a substituted or unsubstituted alkylthio group, a substituted or unsubstituted arylthio group, a substituted or unsubstituted amino group, a substituted or unsubstituted alkylcarbonylamino group, a substituted or unsubstituted arylcarbonylamino group, a substituted or unsubstituted alkylsulfonylamino group, a substituted or unsubstituted arylsulfonylamino group, a substituted or unsubstituted alkoxycarbonylamino group, a substituted or unsubstituted aryloxycarbonylamino group, a substituted or unsubstituted alkylthiocarbonylamino group, a substituted or unsubstituted arylthiocarbonylamino group, a substituted or unsubstituted alkylphosphoramidate group, a substituted or unsubstituted arylphosphoramidate group, a substituted or unsubstituted alkylphosphonamidate group, a substituted or unsubstituted arylphosphonamidate group, a substituted or unsubstituted alkylaminocarbonyl group, a substituted or unsubstituted arylaminocarbonyl group; or $R^{14}$ represents the necessary atoms to close a alicyclic or aromatic or heterocyclic ring fused-on the phenyl ring;

r represents 0, 1, 2, 3 or 4; the $R^{14}$ substituents may be the same or different when r is greater than 1;

$R^{13}$ can have any of the significances given to $R^{14}$ or can represent the necessary atoms to close a alicyclic or aromatic or heterocyclic ring fused-on the phenylene ring;

q represents 0, 1, 2, 3 or 4; the $R^{13}$ substituents may be the same or different when q is greater than 1;

$R^{15}$ and $R^{16}$ each independently represent hydrogen, a substituted or unsubstituted alkyl group, a substituted or unsubstituted cycloalkyl group, a substituted or unsubstituted aryl group, a substituted or unsubstituted allyl group, a substituted or unsubstituted alkenyl group, or $R^{15}$ and $R^{16}$ together with the nitrogen to which they are attached form the necessary atoms to close a 5- or 6-membered heterocyclic ring, or $R^{15}$ and/or $R^{16}$ together with the nitrogen to which they are attached and either or both carbon atoms of the phenyl ring ortho to said nitrogen atom form a 5- or 6-membered heterocyclic ring.

15. Black colored dye-donor element according to claim 14, wherein $R^{15}$ and $R^{16}$ (same or different) represent an alkyl group and wherein r equals 0 or 1 with $R^{14}$ being an alkyl group in case r equals 1 and wherein $R^{13}$ represents a halogen atom or an alkylcarbonylamino group or an alkylaminocarbonyl group and/or $R^{13}$ represents the necessary atoms to close a benzene ring fused-on the phenylene ring.

16. Black colored dye-donor element according to claim 7, wherein the yellow dye is an arylazoaniline dye.

17. Black colored dye-donor element according to claim 1, wherein the dye layer comprises a binder selected from the group consisting of cellulose acetate propionate, cellulose acetate butyrate, copoly-vinyl-n-butyral-vinylacetal-vinylalcohol, copolyvinylchloride-vinylacetate, co-acrylonitrile-styrene and nitrocellulose.

18. Dyed receiving element comprising dyes in imagewise distribution, formed by thermal dye sublimation transfer using a black colored dye-donor element according to claim 1.

19. Dyed receiving element according to claim 18, wherein the support of said receiving element is transparent.

20. Dyed receiving element according to claim 18, wherein the support of said receiving element is blue-colored polyethylene terephthalate.

* * * * *